US005970966A

United States Patent [19]

Sato

[11] Patent Number: 5,970,966

[45] Date of Patent: Oct. 26, 1999

[54] ENGINE AIR-FUEL RATIO CONTROLLER

[75] Inventor: Ritsuo Sato, Yokohama, Japan

[73] Assignee: Nissan Motor Co., Ltd., Yokohama, Japan

[21] Appl. No.: 08/985,057

[22] Filed: Dec. 4, 1997

[30] Foreign Application Priority Data

Dec. 4, 1996 [JP] Japan ..... 8-323954

[51] Int. Cl.[6] ..... F02M 25/00

[52] U.S. Cl. ..... 123/674; 123/681

[58] Field of Search ..... 123/674, 679, 123/685, 683, 684, 696, 436

[56] References Cited

U.S. PATENT DOCUMENTS 5,787,867 8/1998 Schnaibel et al. ..... 123/674
5,797,261 8/1998 Akazaki et al. ..... 123/674

FOREIGN PATENT DOCUMENTS 64-36941 2/1989 Japan .
7-269398 10/1995 Japan .

*Primary Examiner*—John Kwon
*Attorney, Agent, or Firm*—Foley & Lardner

[57] ABSTRACT

In an engine air-fuel ratio controller, a target frequency of an air-fuel ratio oscillation is set to a value different from a natural vibration frequency of a drive mechanism, and an air-fuel ratio feedback correction coefficient is set so that the air-fuel ratio oscillation frequency coincides with the target frequency, and the air-fuel ratio is rich for a longer time than the time for which it is lean. In this way, resonance of the air-fuel ratio oscillation frequency with the natural vibration frequency of the drive system is prevented, the air-fuel ratio is prevented from remaining lean in the high load region for a long period of time, and decline of driving performance is avoided.

17 Claims, 11 Drawing Sheets

α

OSR1

F1

TIMER
Tf

F3
SINCE OSCILLATION PERIOD OF α IS LARGER THAN Tf, α IS NOT MAINTAINED AND PR IS SUBTRACTED FROM α

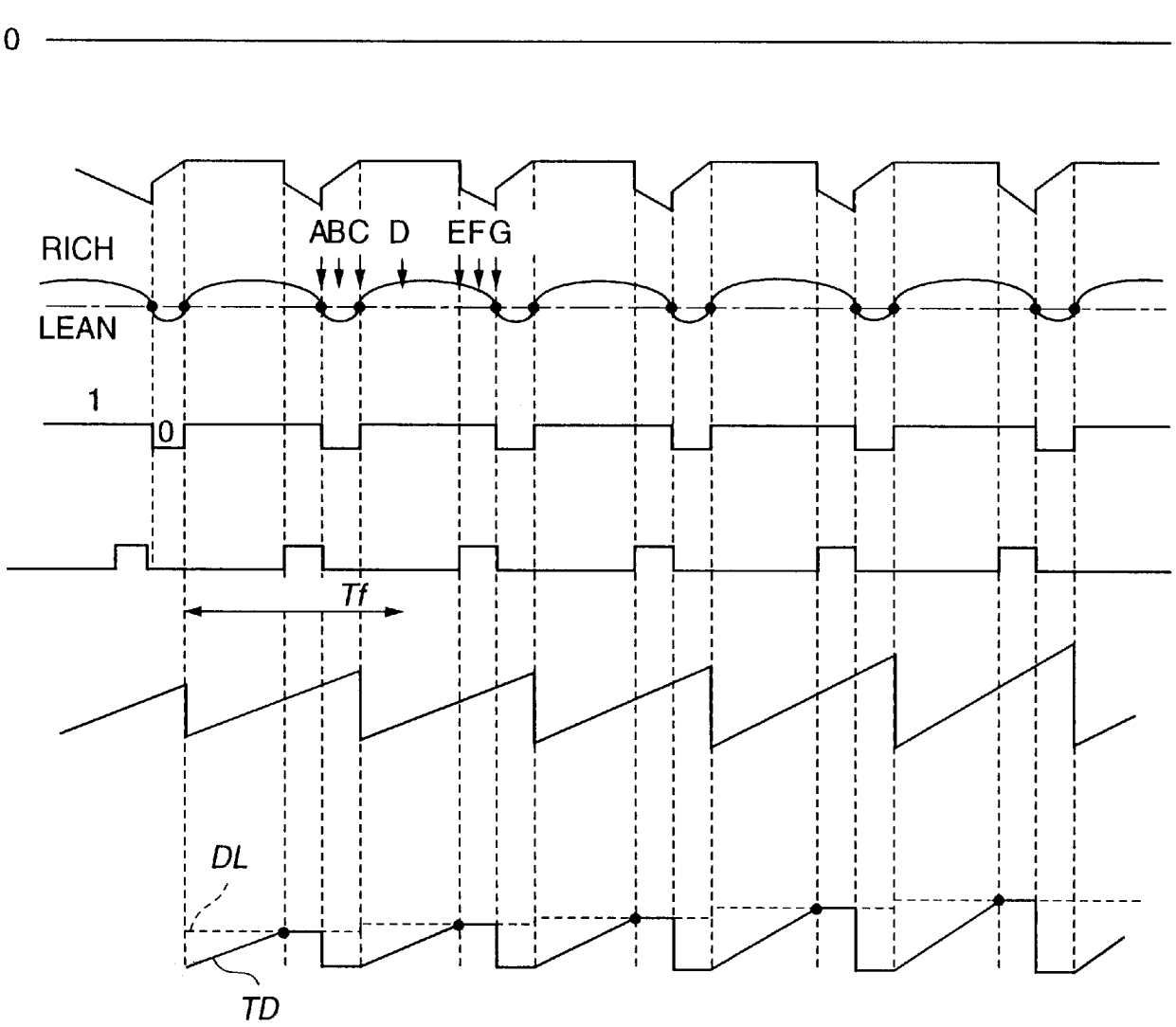
FIG. 7A $F2$
FIG. 7B $\alpha$
FIG. 7C $OSR1$
FIG. 7D $F1$
FIG. 7E $F3$
FIG. 7F $TIMER$
FIG. 7G $TD$

*DL* MAP

| INTAKE AIR VOLUME | 1 | 2 | 3 | 4 |
|---|---|---|---|---|
| Q4 | 0.8 | 0.4 | 0 | 0 |
| Q3 | 0.6 | 0.3 | 0 | 0 |
| Q2 | 0.4 | 0.2 | 0 | 0 |
| Q1 | | | | |

GEAR POSITION

*DL* MAP

| ENGINE ROTATION SPEED (rpm) | 1 | 2 | 3 | 4 |
|---|---|---|---|---|
| 6000 | 0.8 | 0.4 | 0 | 0 |
| 4000 | 0.6 | 0.3 | 0 | 0 |
| 2000 | 0.4 | 0.2 | 0 | 0 |
| 0 | | | | |

GEAR POSITION

FIG. 10

ENGINE AIR-FUEL RATIO CONTROLLER

The contents of Tokugan Hei 8-323954, with a filing date of Dec. 4, 1996 in Japan, are hereby incorporated by reference.

FIELD OF THE INVENTION

This invention relates to an air-fuel ratio control of an engine.

BACKGROUND OF THE INVENTION

In feedback control of an air-fuel ratio of a vehicle engine, the air-fuel ratio oscillates about a target value due to factors such as the response speed of sensors used to detect the air-fuel ratio. This oscillation leads to a variation of engine torque, and if the frequency of the air-fuel ratio oscillation coincides with the natural vibration frequency of the drive system from the transmission to the vehicle wheels, resonance occurs and causes the vehicle to vibrate.

To prevent this vibration, Tokkai Sho 64-36941 published by the Japanese Patent Office in 1989 discloses a technique whereby, when the oscillation frequency of the air-fuel ratio coincides with the natural vibration frequency of the drive system, a control constant of the air-fuel ratio feedback control is altered.

Since the natural vibration frequency of the drive system is different according to the shift position of the transmission, this control constant is altered according to the shift position of the transmission during air-fuel ratio feedback control by comparing the corresponding natural frequency with the air-fuel ratio oscillation frequency.

However in the high load region of the engine where generated drive force is quite sensitive to the variation of air-fuel ratio, if the air-fuel ratio fluctuation frequency decreases due to alteration of the control constant, i.e. if the period of the air-fuel ratio oscillation increases, an air-fuel ratio which is leaner than a target air-fuel ratio predominates for a longer period of time. This leads to a deficiency of drive force and has an undesirable effect on the driving performance of the vehicle.

Tokkai Hei 7-269398 published by the Japanese Patent Office in 1995 discloses another technique whereby a target frequency different from that of the natural vibration frequency of the drive system is preset, and a control variable of air-fuel ratio feedback control is controlled so that the air-fuel ratio oscillation frequency coincides with this target frequency.

However according to this prior art technique, as the target frequency during steady state engine running conditions is set to a lower frequency band than the natural vibration frequency of the drive system, the control still causes the vehicle to be driven at a lean air-fuel ratio for long periods of time.

SUMMARY OF THE INVENTION

It is therefore an object of this invention to set the air-fuel ratio oscillation frequency of an engine so as not to coincide with that of the natural vibration frequency of a drive system, while preventing a decline in vehicle driving performance.

In order to achieve the above object, this invention provides an air-fuel ratio controller wherein an air-fuel ratio of an air-fuel mixture supplied to an engine is detected by an air-fuel ratio sensor and feedback control is performed so that the air-fuel ratio oscillates between rich and lean about a predetermined target value as center. The engine is connected to a drive system having a natural vibration frequency.

The controller comprises a microprocessor programmed to set a target frequency of the air-fuel ratio oscillation to a value different from the natural vibration frequency, measure a frequency of the air-fuel ratio oscillation, and calculate a feedback correction coefficient of the air-fuel ratio such that the air-fuel ratio oscillation frequency coincides with the target frequency, and such that the time for which the air-fuel ratio is rich is longer than the time for which the air-fuel ratio is lean. The controller also comprises an air-fuel ratio modifying mechanism which modifies the air-fuel ratio of the air-fuel mixture supplied to the engine according to the air-fuel ratio correction coefficient.

It is preferable that the air-fuel ratio modifying mechanism comprises a fuel injection valve for injecting fuel into intake air of the engine.

It is also preferable that the microprocessor is programmed to measure the period of the air-fuel ratio oscillation, and when the air-fuel ratio oscillation period is less than a target period corresponding to the target frequency, updating of the air-fuel ratio correction coefficient is suspended for a time corresponding to a difference between the air-fuel ratio oscillation period and the target period.

It is also preferable that the microprocessor is further programmed to release suspension of updating of the air-fuel ratio correction coefficient when the air-fuel ratio oscillation period reaches the target period.

It is also preferable that the controller further comprises a load sensor for detecting a load of the engine, and the microprocessor is further programmed to suspend updating of the air-fuel ratio correction coefficient only when the engine is in a predetermined high load region.

The load sensor for example comprises an air flow meter for detecting an intake air volume of the engine.

It is also preferable that the target frequency is set lower than the natural vibration frequency.

If the drive system comprises a transmission having a plurality of gear ratios, it is preferable that the air-fuel ratio controller comprises a sensor for detecting a gear ratio, and the microprocessor is further programmed to respectively set the target frequency for each gear ratio.

It is also preferable that the controller further comprises a load sensor for detecting a load of the engine, and the microprocessor is further programmed to modify the air-fuel ratio oscillation frequency according to whether the engine is within a predetermined high load region or not within a predetermined high load region.

It is also preferable that the microprocessor is further programmed to start measuring an elapsed time from when the air-fuel ratio changes from lean to rich, suspend updating of the air-fuel ratio correction coefficient until the elapsed time reaches a predetermined delay time learning value, measure a period of the air-fuel ratio oscillation and update the delay time learning value based on a difference between the air-fuel ratio oscillation period and a target period corresponding to the target frequency.

In this case, it is further preferable that the microprocessor is further programmed to release suspension of updating of the air-fuel ratio feedback correction coefficient when the elapsed time reaches the delay time learning value.

It is also preferable that the controller further comprises a load sensor for detecting a load of the engine, and the microprocessor is further programmed to suspend updating of the air-fuel ratio correction coefficient only when the engine is in a predetermined high load region.

It is also preferable that the microprocessor is programmed to update the delay time learning value by the following equation:

$$DL=DL(\text{old})+K1\cdot(Tf-\text{TIMER})$$

where,

DL(old)=DL on immediately preceding occasion

K1=update proportion (positive constant)

If the drive system comprises a transmission comprising a plurality of gear ratios, it is preferable that the air-fuel ratio controller comprises a sensor for detecting a gear ratio, and the microprocessor is further programmed to store the delay time learning value as a delay time learning stored value for each gear ratio, and the delay time learning stored value corresponding to the gear ratio when the elapsed time is measured, is applied as the value on the immediately preceding occasion of the delay time learning value.

It is also preferable that the controller further comprises a load sensor for detecting a load of the engine, and the microprocessor is further programmed to store the delay time learning value as a delay time learning stored value for each predetermined load region, and the delay time learning stored value corresponding to the load when the elapsed time is measured, is applied as the value on the immediately preceding occasion of the delay time learning value.

It is also preferable that the controller further comprises a rotation speed sensor for detecting a rotation speed of the engine, and the microprocessor is further programmed to store the delay time learning value as a delay time learning stored value for each predetermined rotation speed region of the engine, and apply the delay time learning stored value corresponding to the rotation speed of the engine when the elapsed time is measured, as the value on the immediately preceding occasion of the delay time learning value.

This invention also provides an air-fuel ratio controller comprising a mechanism for setting a target frequency of the air-fuel ratio oscillation to a value different from the natural vibration frequency, a mechanism for measuring a frequency of the air-fuel ratio oscillation, a mechanism for calculating a feedback correction coefficient of the air-fuel ratio such that the air-fuel ratio oscillation frequency coincides with the target frequency, and such that the time for which the air-fuel ratio is rich is longer than the time for which the air-fuel ratio is lean, and a mechanism for modifying the air-fuel ratio of the air-fuel mixture supplied to the engine according to the air-fuel ratio correction coefficient.

The details as well as other features and advantages of this invention are set forth in the remainder of the specification and are shown in the accompanying drawings.

BRIEF DESCRIPTION OF THE DRAWINGS

FIGS. 7A–7G are timing charts showing a result of air-fuel ratio control when an engine is on high load performed by the air-fuel ratio controller according to the second embodiment.

FIG. 10 is similar to FIG. 8, but showing a fourth embodiment of this invention.

DESCRIPTION OF THE PREFERRED EMBODIMENTS

Figure 1:
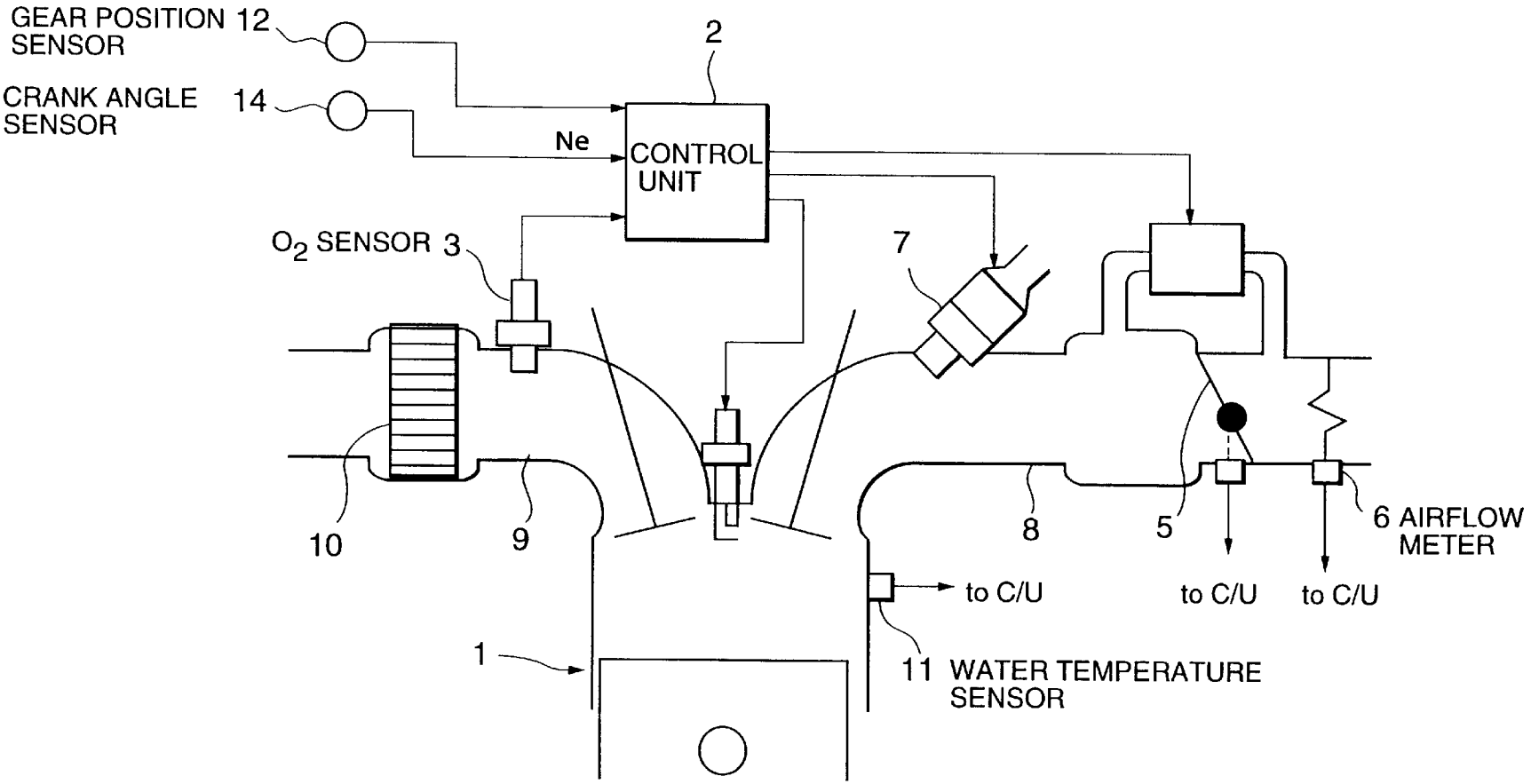
FIG. 1 is a schematic diagram of an air-fuel ratio controller according to this invention.

Referring to FIG. 1 of the drawings, a throttle 5 is provided in an intake passage 8 of a four-stroke cycle vehicle engine 1. A fuel injection valve 7 is provided downstream of the throttle 5 in the intake passage 8. The fuel injection valve 7 injects fuel into the air aspirated through the intake passage 8 to the engine 1, according to an injection signal output by a control unit 2.

A Ref signal (standard position signal) from a crank angle sensor 14 and a Pos signal (1-degree signal), an intake air amount signal from an air flow meter 6, and an engine cooling water temperature signal from a water temperature sensor 11, are input to the control unit 2.

The engine 1 transmits a drive force to the wheels of the vehicle via a drive system, not illustrated. The drive system comprises a transmission. The gear position of this transmission is detected by a gear position sensor 12, and is input to the control unit 2 as a gear position signal.

Based on these input signals, the control unit 2 calculates a basic injection pulse width Tp which corresponds to a basic value of the fuel injection amount of the fuel injection valve 7.

A three-way catalytic converter 10 is provided in an exhaust passage 9 of the engine 1. The three-way catalytic converter 10 has the function of converting nitrogen oxide (NOx), hydrocarbons (HC) and carbon monoxide (CO) to harmless substances, the conversion efficiency being a maximum in a predetermined air-fuel ratio range centered on a stoichiometric air-fuel ratio.

A signal from an $O_2$ sensor 3 provided upstream of the three-way catalytic converter 10 in the exhaust passage 9 is input to the control unit 2. Based on this input signal, the control unit 2 performs a feedback control of the air-fuel ratio so that the air-fuel ratio oscillates with a constant frequency within the above range.

In this case, in order to improve the conversion efficiency of the three-way catalytic converter 10, the frequency of air-fuel fluctuation due to air-fuel ratio feedback control must be large.

However, as described hereinabove, when the frequency of air-fuel ratio fluctuation becomes equal to the natural frequency of the drive system, vibration of the vehicle increases. Also, if the control constant of air-fuel ratio feedback control is altered so that the frequency of air-fuel ratio osculation decreases, the time for which a lean air-fuel ratio continues becomes longer, and in particular this has an undesirable effect on driving performance in the high engine load region.

In the high engine load region, the control unit 2 according to this invention controls the oscillation frequency of the air-fuel ratio to be lower than the natural frequency of the drive system as in the prior art controllers, but at the same time it performs air-fuel ratio control so that the time for which the vehicle runs on a rich air-fuel ratio is longer.

Next, this control process performed by the control unit 2 will be described referring to the flowcharts of FIGS. 2A and 2B.

Figure 2A:
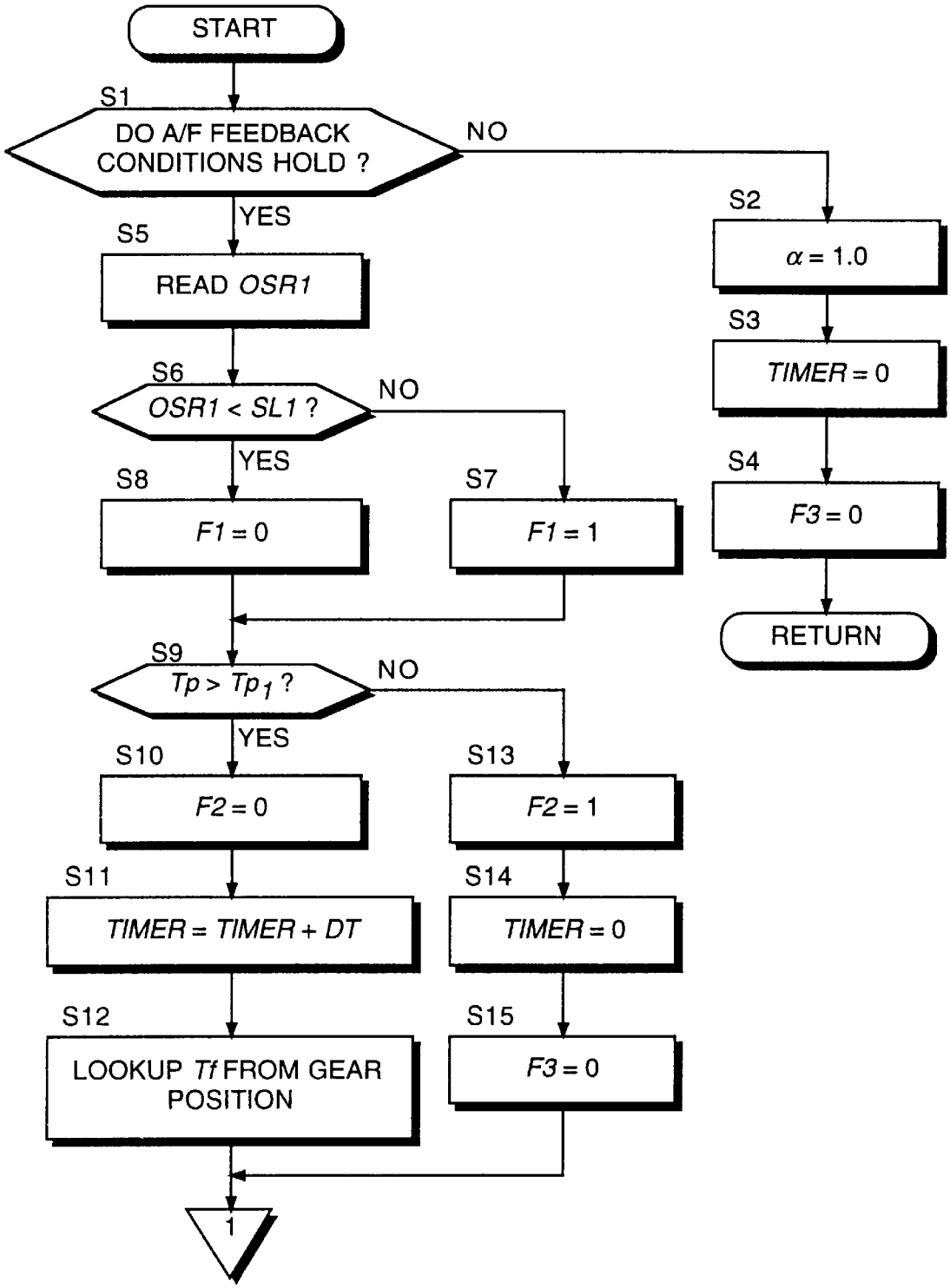
FIGS. 2A and 2B are flowcharts for describing a process of computing an air-fuel ratio feedback correction coefficient $\alpha$ performed by the air-fuel ratio controller.
Figure 2B:
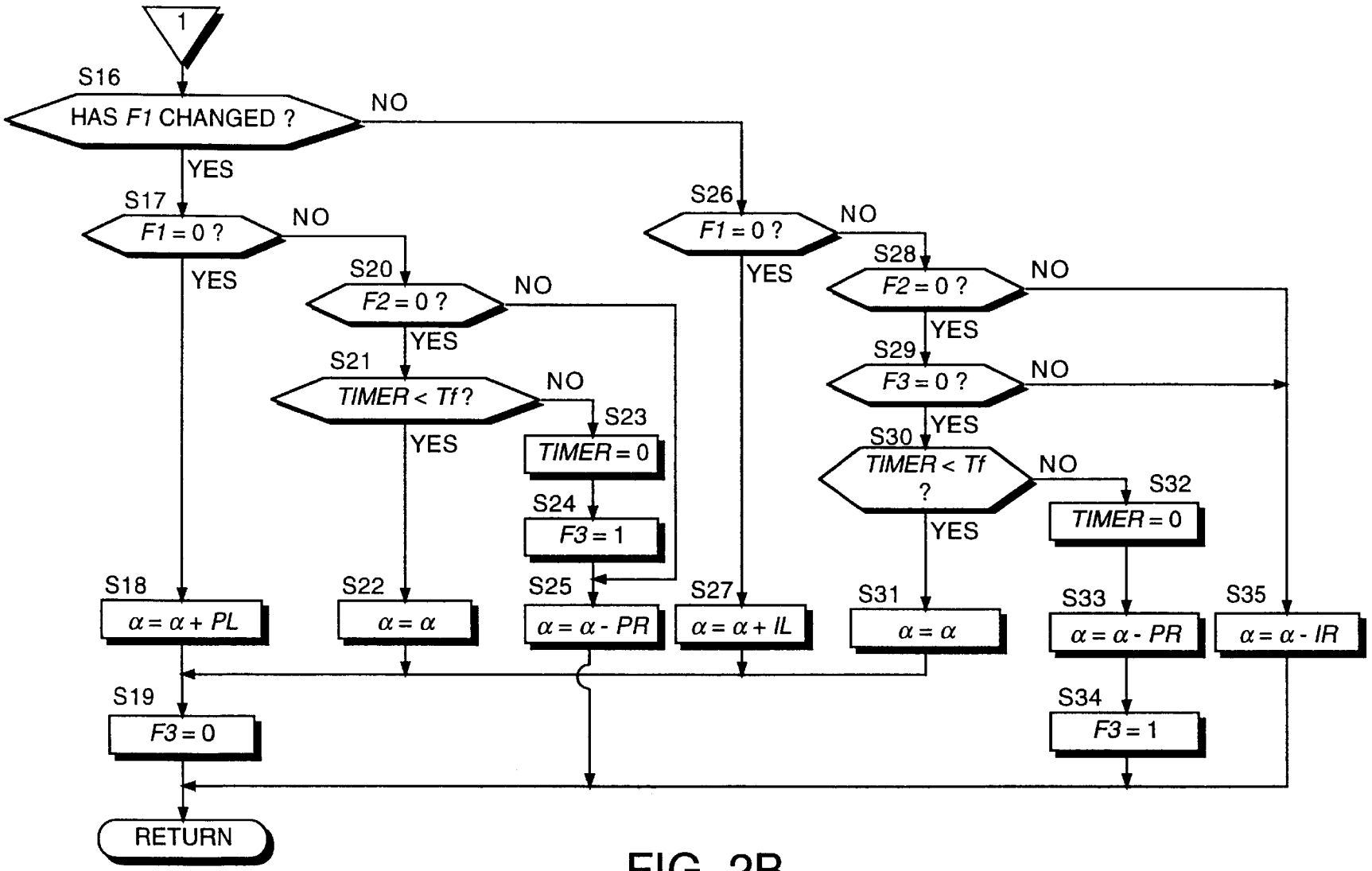

The steps S3, S4, S9, S10, S11 , S13, S14, S15 of FIG. 2A and the steps S19–S24 and S28–S34 of FIG. 2B, are new steps specific to this invention, the remaining steps being known from the prior art.

First, in a step S1, the control unit 2 determines whether or not air-fuel ratio feedback control conditions hold. Conditions when air-fuel ratio feedback control is not performed are, for example, during engine startup, when engine cooling water temperature is low, when there is a fault in the $O_2$ sensor 3 or when the period of rich/lean variation of the output signal from the $O_2$ sensor 3 is equal to or greater than a predetermined value. When none of these conditions holds, it is determined that air-fuel ratio feedback control conditions hold.

When air-fuel ratio feedback control conditions do not hold, an air-fuel ratio feedback correction coefficient $\alpha$ is fixed at 1.0 in a step S2.

In the next step S3, "0" is entered in a TIMER value TIMER, "0" is entered in a flag F3, and the process is terminated.

Herein, the TIMER value TIMER and flag F3 are used only when air-fuel ratio feedback control conditions hold and the engine is running in the high load region. Accordingly, when air-fuel ratio feedback control conditions do not hold, "0" is entered in the TIMER value TIMER and "0" is entered in the flag F3. On engine startup, the TIMER value TIMER is initialized to "0" and the flag F3 is initialized to "0" together with the flags F1, F2 described hereafter.

In a step S1, when air-fuel ratio feedback control conditions hold, the routine proceeds to a step S5, and an output signal OSR1 of the $O_2$ sensor is A/D converted and read.

In a step S6, a slice level SL 1 is compared with this OSR1. The slice level is set to, for example, the vicinity of 500 mV. When OSR1≧SL1, it is determined that the air-fuel ratio is rich, and "1" is entered in a flag F1 in a step S7.

When OSR1<SL1, it is determined that the air-fuel ratio is lean, and "0" is entered in the flag F1. The flag F1 is a flag denoting whether the output signal of the $O_2$ sensor 3 indicates rich or lean.

In the step S9, a predetermined value $Tp_1$ is compared with a basic injection pulse width Tp, and when $Tp>Tp_1$, it is determined that the engine is being run in the heavy load region. In this case, "0" is entered in the flag F2 in the step S10. On the other hand, when $Tp \leqq Tp_1$, it is determined that the engine is running in a region other than the high load region, and "1" is entered in the flag F2 in a step S13. The flag F2 is a flag denoting whether or not the engine is running in the high load region.

In the high load region of the engine, in a step S11, the TIMER value TIMER is incremented. Also, a table shown in FIG. 3 is searched from the gear position of the transmission at that time in a step S12, and the target period Tf of the air-fuel ratio oscillation is set.

The TIMER value TIMER is a TIMER measuring an elapsed time starting from a time obtained by subtracting a proportional part PR from the air-fuel ratio feedback control coefficient $\alpha$.

Figure 3:
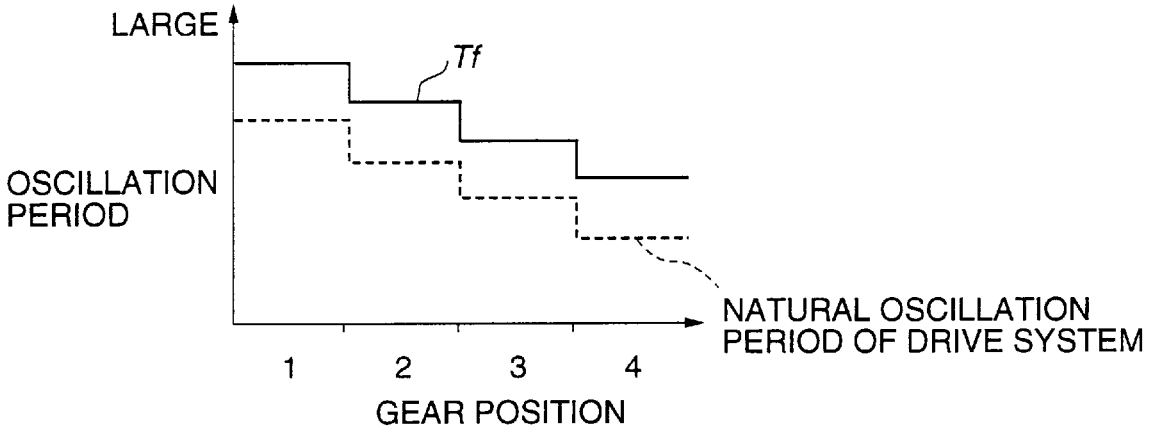
FIG. 3 is a diagram showing the contents of a table of a target period Tf stored by the air-fuel ratio controller.

As shown in FIG. 3, the target period Tf is set larger than a period corresponding to the natural frequency of the drive system. In other words, the frequency is set to a lower frequency than the natural frequency of the drive system. However, it is set so that deviation from the period of the natural frequency is not excessively large.

The reason why it is set so as not to excessively deviate from the natural frequency of the drive system is because the conversion efficiency of the three-way catalytic converter 10 improves, and a more desirable exhaust composition is obtained, the shorter the target period.

On the other hand, when the engine is not running in the high load region, "0" is entered in TIMER in a step S14 following the step S13, and "0" is entered in the flag F3 in a step S15. This is because TIMER and F3 are unnecessary for processing when the engine is not running in the high load region.

After the processing of the steps S12, S15, the routine proceeds to a step S16 of FIG. 2B.

Here, it is determined whether or not the value of the flag F1 is the same on this occasion as on the immediately preceding occasion when the process was executed. When the value of F1 is different from the value on the immediately preceding occasion, it indicates that the output signal of the $O_2$ sensor 3 varied from rich to lean or from lean to rich beyond the slice level. In this case, the processing of a step S17 and subsequent steps is executed. On the other hand when the value of F1 is the same as on the immediately preceding occasion, it indicates that the output signal of the $O_2$ sensor 3 has not varied beyond the slice level. In this case, the processing of a step S26 and subsequent steps is executed.

These two cases will now be considered separately.

(1) Output Signal of $O_2$ Sensor 3 Varies Beyond Slice Level

First, the value of the flag F1 is determined in the step S17. When F1=0, it indicates that the air-fuel ratio has changed from rich to lean. This corresponds to, for example, point A in FIG. 4D. In this case, the air-fuel ratio feedback correction coefficient $\alpha$ is updated by adding a proportional part PL to the air-fuel ratio feedback correction coefficient $\alpha$ on the immediately preceding occasion in a step S18.

Figures 4A, 4B, 4C, 4D, 4E, 4F, 4G:
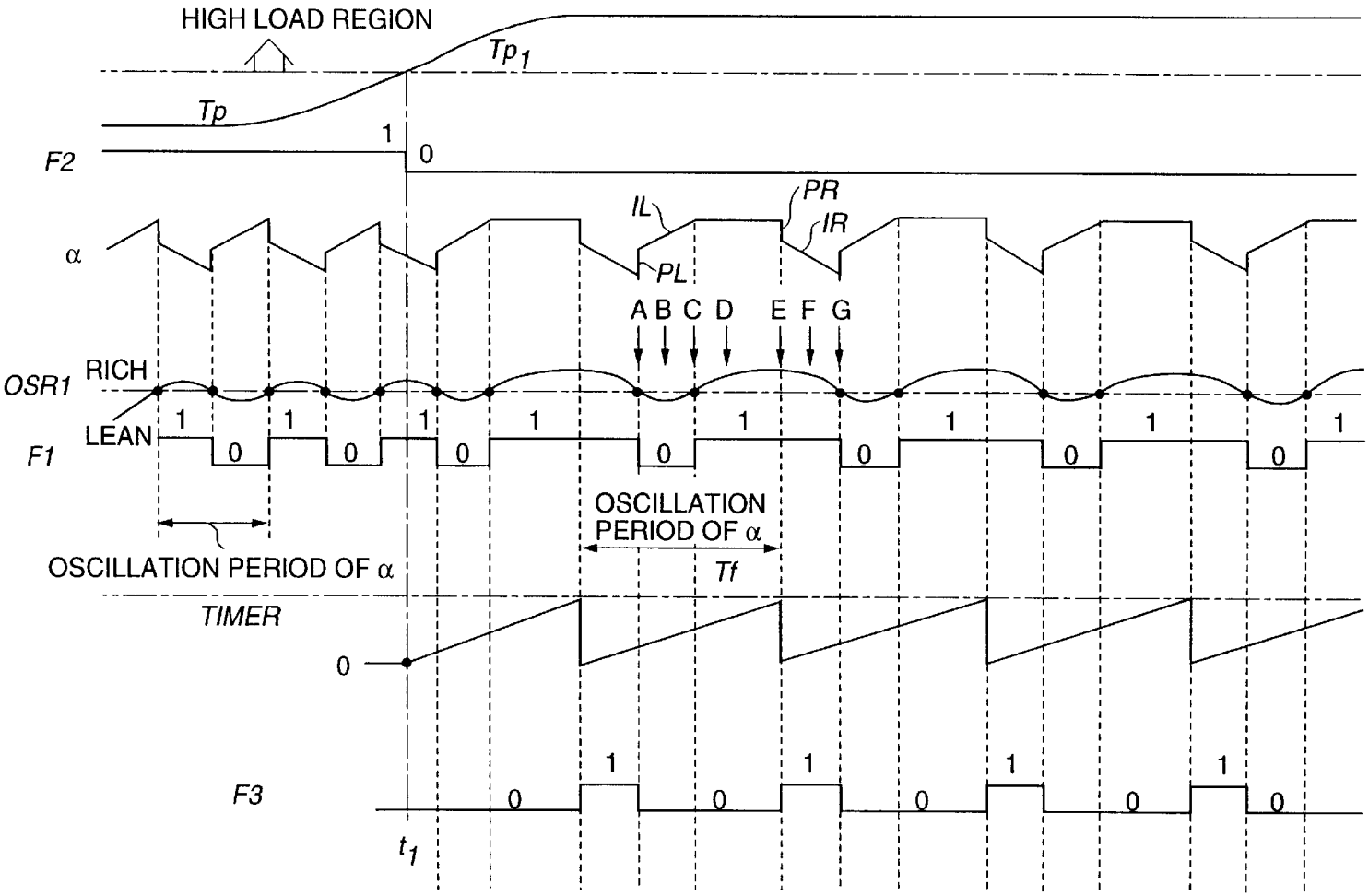
FIGS. 4A–4G are timing charts showing a result of control performed by the air-fuel ratio controller.
Figures 5A, 5B, 5C, 5D, 5E:
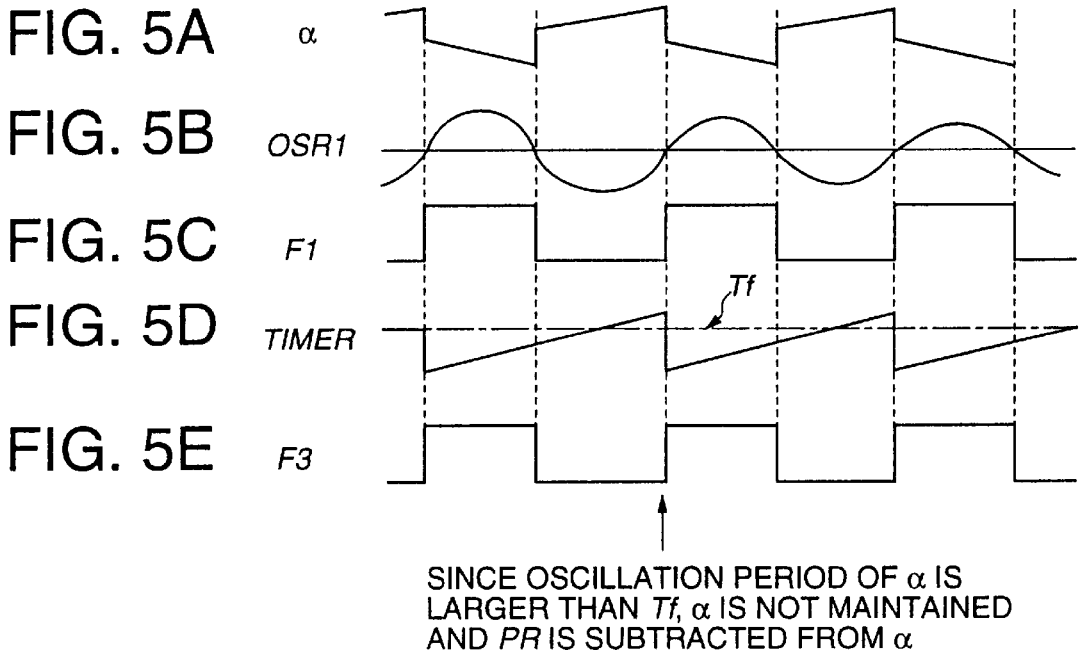
FIGS. 5A–5E are timing charts showing another result of control performed by the air-fuel ratio controller.

In a step S19, "0" is entered in the flag F3 and the present operation is terminated. The flag F3 is set to "1" from when the proportional part PR is subtracted from the air-fuel ratio feedback coefficient $\alpha$ until the air-fuel ratio again becomes lean, as shown in FIG. 4G, and is set to "0" at all other times. If F1=1, it shows that the air-fuel ratio has changed from lean to rich. This corresponds to, for example, point C of FIG. 4D. In this case, the flag F2 is determined in a step S20. When F2=0, i.e. when the engine is running in the high load region, the TIMER value TIMER is set to the target value Tf in a step S21.

When TIMER<Tf, the oscillation period of the air-fuel ratio feedback control coefficient a is less than the target period. The routine therefore proceeds to a step S22, the air-fuel ratio feedback control coefficient $\alpha$ on the immediately preceding occasion is set to the present air-fuel ratio feedback control coefficient $\alpha$, the operation of the aforementioned step S19 is executed, and the process is terminated.

When TIMER≧Tf, the routine proceeds from the step S21 to the steps S23, S24 and S25. In the step S23, "0" is entered in TIMER. In the step S24, "1" is entered in the flag F3. In the step S25, the air-fuel ratio feedback control coefficient $\alpha$ is updated by subtracting the proportional part PR from the air-fuel ratio feedback control coefficient $\alpha$. This processing is performed when TIMER has already exceeded the target period Tf at the time when the output signal of the $O_2$ sensor changes from lean to rich, as shown in FIGS. 5A–5E. This situation occurs for example when a high gear is applied in the transmission, and the period of natural vibration of the drive system is shorter than the oscillation period of the air-fuel ratio. In this case, there is no resonance between the torque fluctuation and the natural vibration of the drive system, and therefore there is no need to deliberately alter the oscillation period of the air-fuel ratio. Therefore in the step S25, the air-fuel ratio feedback control coefficient α is updated by subtracting the proportional part PR as in the case of the normal air-fuel ratio feedback control pattern.

Also in the case when it is determined in the step S20 that the engine is not being driven in the high load region, the routine proceeds to the step S25 from the step S20, and the air-fuel ratio feedback coefficient α is updated by subtracting the proportional part PR from the air-fuel ratio feedback coefficient α. The state wherein the engine is not being driven in the high load region corresponds to, for example, the part where F2=1 in FIGS. 4A–4E. In this state, normal air-fuel ratio feedback control is performed.

(2) Output Signal of $O_2$ Sensor 3 Does Not Vary Beyond Slice Level

First, the value of the flag F1 value is determined in a step S26. When F1=0, it shows that lean conditions are continuing from the immediately preceding occasion when the process was executed. This corresponds to, for example, point B in FIG. 4D.

In this case, the air-fuel ratio feedback correction coefficient α is updated by adding an integral part IL to the air-fuel ratio feedback correction coefficient α on the immediately preceding occasion in a step S27. Finally, the operation of the aforesaid step S19 is performed and the present operation is terminated.

If F1=1, it shows that the air-fuel ratio is still rich following the immediately preceding occasion when the process was executed. In this case, the flag F2 is determined in a step S28. When F2=0, i.e. when the engine is running in the high load region, the flag F3 is determined in a step S29. When air-fuel ratio feedback conditions and high load conditions hold, as shown in FIG. 4G, the flag F3 is set to "1" when the proportional part PR is subtracted from the air-fuel ratio feedback control coefficient α, and is then reset to "0" when the proportional part PL is added.

When F3=0 in the step S29, the TIMER value TIMER is compared with the target value Tf in a step S30.

When TIMER<Tf, the routine proceeds to a step S31, the air-fuel ratio feedback control coefficient α is held, the operation of the step S19 is performed and the present operation is terminated. The processing of the step S31 corresponds to the point D in FIG. 4D.

Provided that the engine is driven in the high load region, this TIMER value TIMER is incremented in the step S11 each time this process is executed, and is reset in a step S32 when it reaches the target value Tf.

This corresponds to, for example, point E in FIG. 4D. In this way, the value of TIMER is reset every target period Tf as shown in FIG. 4F.

At the same time when TIMER is reset, the air-fuel ratio feedback control coefficient α is updated by subtracting the proportional part PR from the air-fuel ratio feedback control coefficient α on the immediately preceding occasion in a step S33 following the step S32.

In a step S34, "1" is entered in the flag F3. Provided that F1=1 (engine continues to run on rich air-fuel ratio) and F2=0 (high load region) due to the setting of "1" in this flag F3, the next and subsequent processes proceed from the step S29 to a step S35. Herein, the air-fuel ratio feedback control coefficient α is updated by subtracting the integral part IR from α on the immediately preceding occasion. This processing corresponds to the point F in FIG. 4D.

Due to subtraction of this integral part IR, the output signal of the $O_2$ sensor 3 eventually changes from rich to lean. This corresponds to, for example, the point G in FIG. 4D. This completes one oscillation cycle of the air-fuel ratio in the high load region with the point A as starting point.

When F2=1 in the step S28, i.e. the engine is not running in the high load region, the routine proceeds to the aforesaid step S35, and the air-fuel ratio feedback coefficient α is updated by subtracting the integral part IR from the air-fuel ratio feedback coefficient α.

The proportional part PR, PL and integral parts IR, IL match the target period Tf so that the air-fuel ratio feedback correction coefficient has the waveform shown in FIG. 4C.

The control unit 2 calculates the fuel injection pulse width Ti output to the fuel injection valve 7 using the air-fuel ratio feedback correction coefficient α computed by the process of FIGS. 2A and 2B, e.g. every 10 milliseconds, by the next equation:

$$Ti=Tp\cdot Co\cdot\alpha\cdot\alpha_m\cdot 2+Ts \tag{1}$$

where,

Tp=basic injection pulse width

Co=sum of 1 and correction coefficients $\alpha_m$=air-fuel ratio learning correction coefficient Ts=ineffectual pulse width $$Tp=\frac{K\cdot Qa}{N} \tag{2}$$

where,

K=constant

Qa=engine intake air volume

N=engine rotation speed

The fuel injection valve 7 performs one fuel injection into each cylinder corresponding to the injection pulse width Ti calculated as described above, each time the engine makes two rotations.

Due to the aforementioned control, air-fuel ratio feedback control using only the proportional parts PR, PL and integral parts IR, IL, is performed outside the high load region of the engine 1. The proportional parts PR, PL and integral part IR, IL are matched so that the air-fuel ratio oscillation frequency is sufficiently large, i.e. so that the air-fuel ratio oscillation period is sufficiently short, in order to obtain a desirable effect on the conversion efficiency of the catalyst in the low load region.

On the other hand in the high load region, as shown in FIGS. 4A–4G,

1) Hold of α starts at the same time as the output signal of the $O_2$ sensor 3 changes from lean to rich,
2) Hold of α terminates when the TIMER value TIMER reaches the target period Tf,
3) The proportional part PR is subtracted from α and the TIMER value TIMER is reset to "0" when the TIMER value TIMER coincides with the target period Tf,
4) Elapsed time is again measured by the TIMER value TIMER, and α is decreased in steps by subtracting the integral part IR until the output signal of the $O_2$ sensor changes to lean,
5) When the output signal of the $O_2$ sensor 3 changes from rich to lean, the proportional part PL is added to α.

6) α is increased in steps by adding the integral part IL until the output signal of the $O_2$ sensor changes to rich.

By holding the air-fuel ratio feedback control coefficient α during the interval from 1) to 2) above, the time for which the engine is run on a rich air-fuel ratio is longer. Hence, suitable driving performance can be maintained in the heavy load region of the engine in which torque fluctuations easily occur under air-fuel ratio feedback control while avoiding resonance with the drive system.

If the timing of subtracting the proportional part PR from the air-fuel ratio feedback coefficient α was merely retarded after the signal output from the $O_2$ sensor changes to rich, the time for which the integral part IL is added would become longer. As a result, the amplitude of the air-fuel ratio fluctuation would increase, and there is a possibility that the air-fuel ratio would drift outside the "catalyst window", i.e. the range in which good catalyst conversion efficiency is obtained. However according to this invention, the air-fuel ratio feedback control coefficient α is held, so the integral part IL is not added for a long time. Therefore even if the air-fuel ratio fluctuation period does increase, the amplitude of the air-fuel ratio does not increase.

FIGS. 6A and 6B and FIGS. 7A–7G show a second embodiment of this invention.

This flowchart is applied instead of the flowchart of the aforesaid first embodiment shown in FIGS. 2A and 2B.

Differences from the flowchart of FIGS. 2A and 2B are that new steps S41–S47 are added, and the steps S21, S23, S24, S30 are eliminated.

In the step S41, the TIMER value TD is reset when air-fuel ratio feedback control conditions do not hold.

In the step S42, the TIMER value TD is reset when air-fuel ratio feedback control conditions hold and the engine is not being run in the high load region. The TIMER value TD measures the elapsed time starting from the point when the output signal of the $O_2$ sensor 3 changes from rich to lean, and it is initialzed to "0" on engine startup.

When the flag F2 is 0 in the step S20, a delay time learning value DL is updated by the following equation in the step S44.

$$DL=DL(\text{old})+K1\cdot(Tf-\text{TIMER}) \quad (3)$$

where,

DL(old)=DL on immediately preceding occasion

K1=update proportion (positive constant)

In a step S45, the TIMER value TIMER is reset. As a result, the TIMER value is reset to "0" when the output signal of the $O_2$ sensor 3 changes from lean to rich, as shown in FIG. 7F. Accordingly, unlike the case of the aforesaid first embodiment, the TIMER value used in the calculation of the step S44 corresponds to the osciation period of the output signal of the $O_2$ sensor 3 taking the time at which the air-fuel ratio changes from lean to rich as starting point.

When the TIMER value TIMER is smaller than the target period Tf, the delay time learning value DL of equation (3) is updated in the increase direction, and when the TIMER value TIMER is larger than the target period Tf, it is updated in the decrease direction. Therefore, if learning progresses, the oscillation period of the output signal of the $O_2$ sensor 3, i.e. the real oscillation period of the air-fuel ratio, coincides with the target period Tf. The delay time learning value DL is stored in a backup RAM for use as DL(old) in the next calculation.

According to this embodiment, when the output signal of $O_2$ sensor 3 continues to be rich in the high load region of the engine, a TIMER value TD and the delay time learning value DL are compared in a step S46. When TD<DL, the TIMER value TD is incremented in a step S47, and the air-fuel ratio feedback control coefficient α is held in a step S31.

When TD≧DL due to repeated incrementation of the TIMER value TD, the routine proceeds from the step S46 to a step S29. The processing of the step S29 and subsequent steps is the same as in the aforesaid first embodiment.

FIGS. 7A–7G shows the changes of the flags F1–F3, air-fuel ratio feedback control coefficient α, output signal OSR1 of the $O_2$ sensor 3, TIMER value TIMER and TD, and delay time learning value DL, in the high load region.

According to the second embodiment, the TIMER value TD and delay time learning value DL are new additions, and the starting point of the TIMER value TIMER is also different.

Figure 6A:
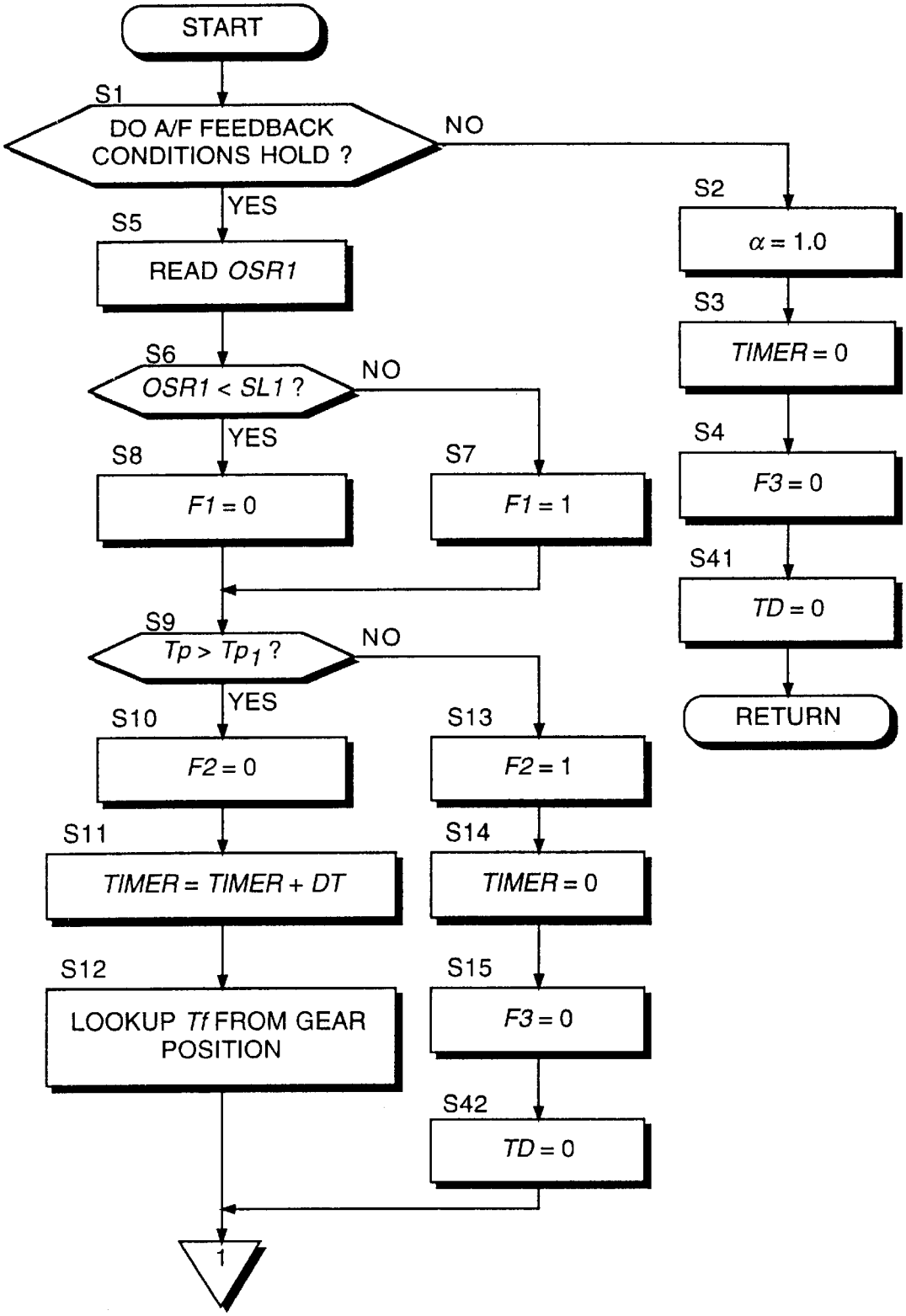
FIGS. 6A and 6B are similar to FIGS. 2A and 2B, but showing a second a embodiment of this invention.
Figure 6B:
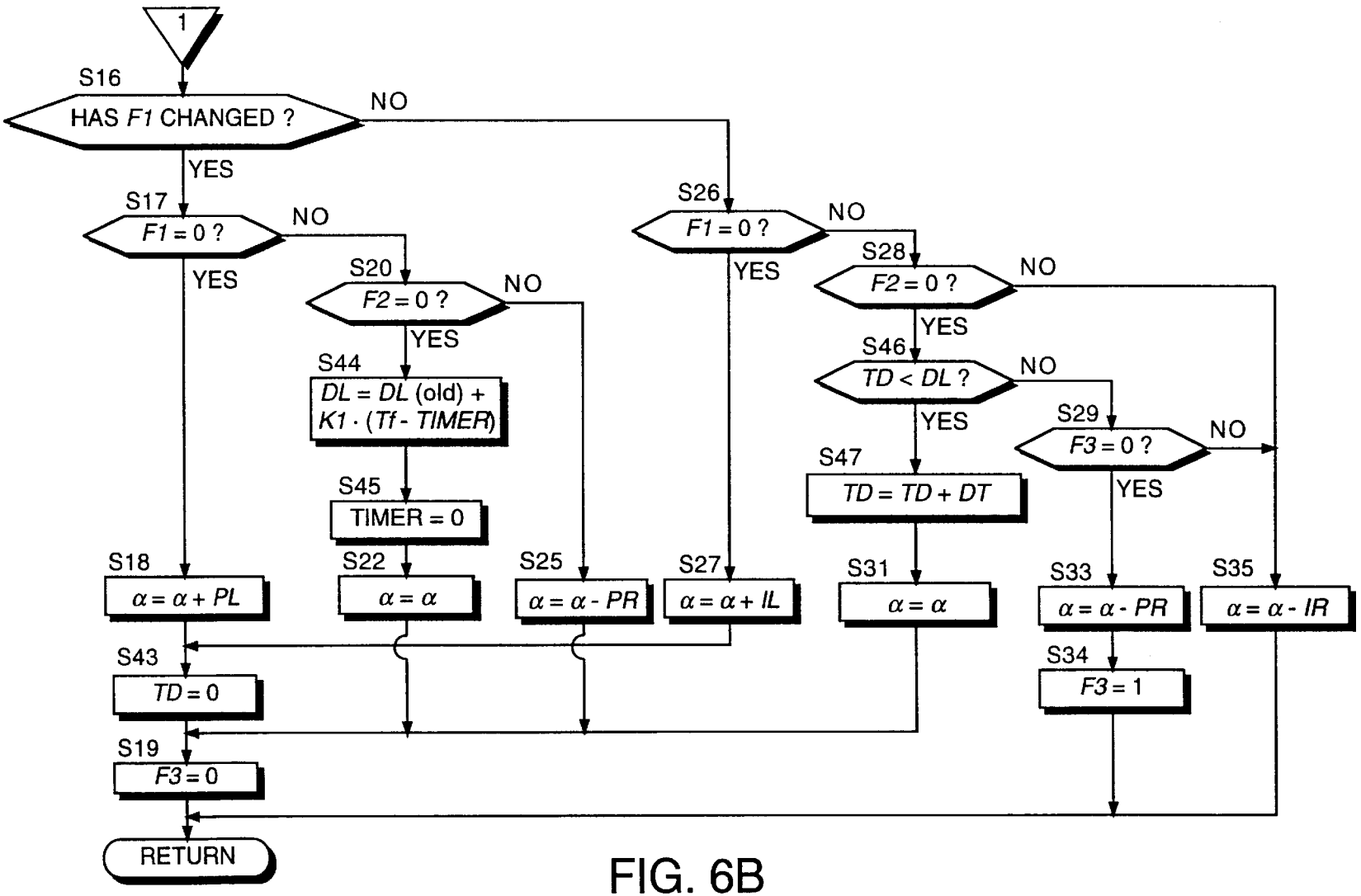

Next, therefore, a description will be given of the operations in the flowcharts of FIG. 6A, 6B which are performed at each of the points B, C, D, E, F, in FIG. 7C.

At point A, the routine proceeds via the steps S16, S17, S18, S43, S19, and the TIMER value TD is reset to "0".

At point B, the routine proceeds via the steps S16, S26, S27, S43, S19, and the TIMER value TD remains at "0".

At point C, the routine proceeds via the steps S16, S17, S20, S44, S45, S22, S19, the delay time learning value DL is updated, and the TIMER value TIMER is reset to "0".

At point D, the routine proceeds via the steps S16, S26, S28, S46, S47, S31, S19, and the TIMER value TD is incremented.

At point E, the routine proceeds via the steps S16, S26, S28, S46, S29, S33, S34, and the TIMER value TD is held.

At point F, the routine proceeds via the steps S16, S26, S28, S46, S29, S35. In this case, the TIMER value TD is held.

The point G is the same as point A.

As shown in FIGS. 7A–7G, the TIMER value TD measures the time from when the output signal of the $O_2$ sensor 3 changes to rich.

Also, when the output signal of the $O_2$ sensor 3 changes to rich, hold of the air-fuel ratio feedback control coefficient α begins, and when the TIMER value TD coincides with the delay time learning value DL, hold of α is terminated. In other words, according to this embodiment, the time when hold of α begins is the same as in the first embodiment, but the time when hold of α ends is different from the first embodiment.

Further, FIG. 7G shows how the delay time learning value DL changes when the TIMER value TIMER is shorter than the target period Tf. When the TIMER value TIMER is shorter than the target period Tf, the delay time learning value DL gradually increases, and levels off at the DL when the TIMER value TIMER coincides with the target period Tf. The hold time of α also gradually increases together with this variation of DL.

According to the second embodiment, in the high load region of the engine:

1) When the output signal of the $O_2$ sensor 3 changes from lean to rich, hold of α begins, and the TIMER value TIMER is reset to "0".

2) The elapsed time is measured by the TIMER value TIMER, and hold of α continues.

3) When the TIMER value TD coincides with the delay time learning value DL, the proportional part PR is subtracted from α and the delay time learning value DL is updated.

4) α is decreased in integral steps IR until the output signal of the $O_2$ sensor 3 changes from rich to lean.

5) When the output signal of the $O_2$ sensor 3 changes from rich to lean, a proportional part PL is added to $\alpha$, and the TIMER value TD is reset.

6) $\alpha$ is increased in integral steps IL until the output signal of the $O_2$ sensor 3 changes from lean to rich.

According to this embodiment, the control is somewhat more complex than that of the first embodiment, but unlike the first embodiment which measures the oscillation period of $\alpha$, the oscillation period of the output signal of the $O_2$ sensor 3, i.e. the real air-fuel ratio oscillation period, is measured directly. The air-fuel ratio oscillation period can therefore be controlled more precisely.

Figures 8, 9:
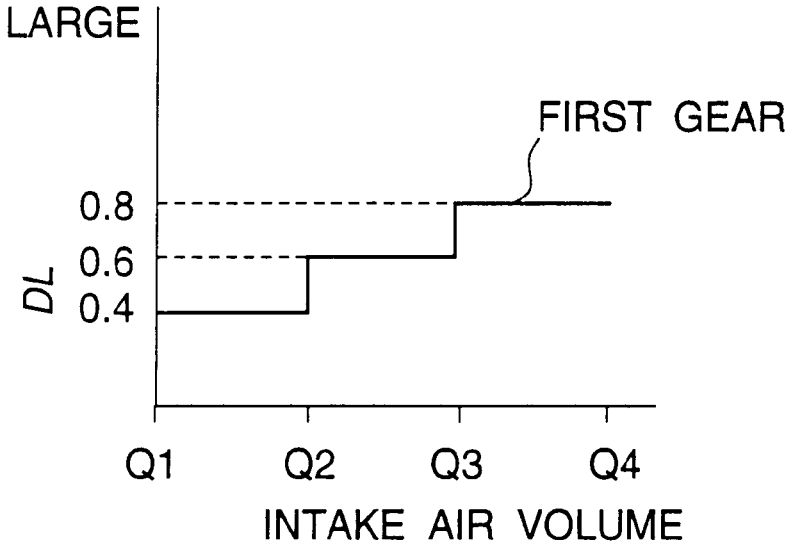
FIG. 8 is a table of a delay time learning value DL stored by the air-fuel ratio controller according to a third embodiment of this invention.
FIG. 9 is a diagram describing the contents of the table of the delay time learning value DL.

FIGS. 8 and 9 show a third embodiment of this invention.

This embodiment relates to storage of the delay time learning value DL in the backup RAM.

As shown in FIG. 8, according to this embodiment, a storage area of the delay time learning value DL applied in the high load region of the engine is divided into three areas by an intake air volume Qa, and these are further divided into four areas according to the gear position so as to obtain a total of 12 areas, and a delay time learning value DL is stored separately in each area. For example as shown in FIG. 9, in first gear, 0.4 is stored as a delay time learning value DL for the intake air volume Qa from Q1 to Q2, 0.6 is stored as a time delay learning value DL from Q1 to Q2, and 0.8 is stored as a time delay learning value DL from Q3 to Q4. In this way, by finely dividing the storage area of DL according to engine running conditions, the air-fuel ratio oscillation period can be precisely controlled over the whole of the high load region of the engine.

FIG. 10 shows a fourth embodiment of this invention.

This is another form of the map of delay time learning value DL of the third embodiment. As the intake air volume Qa is effectively proportional to a rotation speed N in the high load region of the engine, as shown in FIG. 10, the storage area of delay time learning value DL is divided according to the rotation speed N instead of the intake air amount Qa of the third embodiment. The same desirable effect as that of the third embodiment is thereby obtained.

According to the aforesaid embodiments, the oscillation period of $\alpha$ and the oscillation period of the output signal of the $O_2$ sensor 3 were controlled so as to coincide with the target period. It will however be understood that a target frequency may be set so as not to overlap with the natural frequency of the drive system, and control performed so that the oscillation frequency of $\alpha$ and of the output signal of the $O_2$ sensor 3 coincide with this target frequency during air-fuel ratio feedback control.

The corresponding structures, materials, acts, and equivalents of all means plus function elements in the claims below are intended to include any structure, material, or acts for performing the functions in combination with other claimed elements as specifically claimed.

The embodiments of this invention in which an exclusive property or privilege is claimed are defined as follows:

1. An air-fuel ratio controller wherein an air-fuel ratio of an air-fuel mixture supplied to an engine is detected by an air-fuel ratio sensor and feedback control is performed so that said air-fuel ratio oscillates between rich and lean about a predetermined target value as center, said engine being connected to a drive system having a natural vibration frequency, said controller comprising:

a microprocessor programmed to set a target frequency of the air-fuel ratio oscillation to a value different from said natural vibration frequency, measure a frequency of the air-fuel ratio oscillation, and calculate a feedback correction coefficient of said air-fuel ratio such that said air-fuel ratio oscillation frequency is adjusted according to said air-fuel ratio feedback correction coefficient to coincide with said target frequency, and such that, within a single oscillation period of the air-fuel ratio, the time for which said air-fuel ratio is rich is longer than the time for which said air-fuel ratio is lean; and an air-fuel ratio modifying mechanism which modifies the air-fuel ratio of said air-fuel mixture supplied to said engine according to said air-fuel ratio feedback correction coefficient.

2. An air-fuel ratio controller as defined in claim 1, wherein said air-fuel ratio modifying mechanism comprises a fuel injection valve for injecting fuel into intake air of said engine.

3. An air-fuel ratio controller as defined in claim 1, wherein said microprocessor is programmed to measure the period of the air-fuel ratio oscillation from the time the air-fuel ratio changes from rich to lean, and when the air-fuel ratio oscillation period is less than a target period corresponding to said target frequency, updating of the air-fuel ratio feedback correction coefficient is suspended for a time corresponding to a difference between the air-fuel ratio oscillation period and the target period.

4. An air-fuel ratio controller as defined in claim 1, wherein said microprocessor is further programmed to release suspension of updating of the air-fuel ratio feedback correction coefficient when said air-fuel ratio oscillation period reaches said target period.

5. An air-fuel ratio controller as defined in claim 3, wherein said controller further comprises a load sensor for detecting a load of said engine, and said microprocessor is further programmed to suspend updating of the air-fuel ratio feedback correction coefficient only when said engine is in a predetermined high load region.

6. An air-fuel ratio controller as defined in claim 5, wherein said load sensor comprises an air flow meter for detecting an intake air volume of said engine.

7. An air-fuel ratio controller as defined in claim 1, wherein said target frequency is set lower than said natural vibration frequency.

8. An air-fuel ratio controller as defined in claim 1, wherein said drive system comprises a transmission having a plurality of gear ratios, said air-fuel ratio controller comprises a sensor for detecting a gear ratio, and said microprocessor is further programmed to respectively set said target frequency for each gear ratio.

9. An air-fuel ratio controller as defined in claim 1, wherein said controller further comprises a load sensor for detecting a load of said engine, and said microprocessor is further programmed to provide a smaller air-fuel ratio oscillation frequency when said engine is within a predetermined high load region, as compared to when said engine is not within said predetermined high load region.

10. An air-fuel ratio controller as defined in claim 1, wherein said microprocessor is further programmed to start measuring an elapsed time from when the air-fuel ratio changes from lean to rich, suspend updating of the air-fuel ratio feedback correction coefficient until said elapsed time reaches a predetermined delay time learning value, measure a period of the air-fuel ratio oscillation and update said delay time learning value based on a difference between said air-fuel ratio oscillation period and a target period corresponding to said target frequency.

11. An air-fuel ratio controller as defined in claim 10, wherein said microprocessor is further programmed to release suspension of updating of said air-fuel ratio feedback correction coefficient when said elapsed time reaches said delay time learning value.

12. An air-fuel ratio controller as defined in claim 10, wherein said controller further comprises a load sensor for detecting a load of said engine, and said microprocessor is further programmed to suspend updating of the air-fuel ratio feedback correction coefficient only when said engine is in a predetermined high load region.

13. An air-fuel ratio controller as defined in claim 10, wherein said microprocessor is programmed to update said delay time learning value (DL) by the following equation:

$$DL=DL(\text{old})+K1\cdot(Tf-\text{TIMER})$$

where,

DL(old)=DL on immediately preceding occasion

K1=update proportion (positive constant)

Tf=target period

TIMER=TIMER value.

14. An air-fuel ratio controller as defined in claim 13, wherein said drive system comprises a transmission comprising a plurality of gear ratios, said air-fuel ratio controller comprises a sensor for detecting a gear ratio, and said microprocessor is further programmed to store said delay time learning value as a delay time learning stored value for each gear ratio, and the delay time learning stored value corresponding to the gear ratio when said elapsed time is measured, is applied as the value of DL(old).

15. An air-fuel ratio controller as defined in claim 13, wherein said controller further comprises a load sensor for detecting a load of said engine, and said microprocessor is further programmed to store said delay time learning value as a delay time learning stored value for each predetermined load region, and the delay time learning stored value corresponding to the load when said elapsed time is measured, is applied as the value of DL(old).

16. An air-fuel ratio controller as defined in claim 13, wherein said controller further comprises a rotation speed sensor for detecting a rotation speed of said engine, and said microprocessor is further programmed to store said delay time learning value as a delay time learning stored value for each predetermined rotation speed region of said engine, and apply the delay time learning stored value corresponding to the rotation speed of said engine when said elapsed time is measured, as the value of DL(old).

17. An air-fuel ratio controller wherein an air-fuel ratio of an air-fuel mixture supplied to an engine is detected by an air-fuel ratio sensor and feedback control is performed so that said air-fuel ratio oscillates between rich and lean about a predetermined value as center, said engine being connected to a drive system having a natural vibration frequency, said controller comprising:

means for setting a target frequency of the air-fuel ratio oscillation to a value different from said natural vibration frequency;

means for measuring a frequency of the air-fuel ratio oscillation;

means for calculating a feedback correction coefficient of said air-fuel ratio such that said air-fuel ratio oscillation frequency is adjusted according to said air-fuel ratio feedback correction coefficient to coincide with said target frequency, and such that, within a single oscillation period of the air-fuel ratio, the time for which said air-fuel ratio is rich is longer than the time for which said air-fuel ratio is lean; and means for modifying the air-fuel ratio of said air-fuel mixture supplied to said engine according to said air-fuel ratio feedback correction coefficient.

* * * * *